US005931460A

United States Patent [19]

Kadowaki et al.

[11] Patent Number: 5,931,460

[45] Date of Patent: Aug. 3, 1999

[54] SHEET REGISTERING DEVICE

[75] Inventors: Hideaki Kadowaki, Yamatokoriyama; Tatsuya Inoue, Nara, both of Japan

[73] Assignee: Sharp Kabushiki Kaisha, Osaka, Japan

[21] Appl. No.: 08/975,927

[22] Filed: Nov. 21, 1997

[30] Foreign Application Priority Data

Nov. 22, 1996 [JP] Japan ..... P8-311599

[51] Int. Cl.[6] ..... B65H 31/26

[52] U.S. Cl. ..... 271/220; 271/314; 271/213; 270/58.12

[58] Field of Search ..... 271/176, 314, 271/207, 213, 220, 221; 270/58.08, 58.12, 58.17, 58.27

[56] References Cited

U.S. PATENT DOCUMENTS 3,847,388 11/1974 Lynch ..... 271/220
5,765,824 6/1998 Kawano et al. ..... 270/58.12

FOREIGN PATENT DOCUMENTS 360056766 4/1985 Japan ..... 271/220
0002663 1/1986 Japan ..... 271/207
0008160 1/1989 Japan ..... 271/220
1104563 4/1989 Japan .

*Primary Examiner*—H. Grant Skaggs

[57] ABSTRACT

A sheet registering device for registering sheets without any time loss and any fold or breakage of the sheets. A paddler is equipped with two elastic blades, for example, as mounted on a pivotal shaft directed at a right angle with respect to a transporting direction of the sheets, and the adjoining elastic blades are set at an angle of 180° or more. The sheets, as supplied to a staple tray, are transported by the rotating paddler until their downstream ends come into contact with a stopper, and are registered in the transporting direction. At this time, the elastic blades are in contact with the sheet surface. When the transportation and the registration in the transporting direction are ended, the rotation of the paddler stops with its elastic blades being generally in parallel with the tray. After this, the sheets are registered in a (widthwise) direction perpendicular to the transporting direction by a tamper plate. At this time, the elastic blades are kept away from contact with the sheet surface so that no pressure is applied downward to the sheets to neither fold nor break the sheets. Moreover, the transportation and the registration can be effectively carried out not by shifting the paddler itself but merely by controlling the rotation of the same.

5 Claims, 17 Drawing Sheets

SHEET REGISTERING DEVICE

BACKGROUND OF THE INVENTION

1. Field of the Invention

The present invention relates to a sheet registering device for registering a plurality of sheets, supplied to a tray, longitudinally and transversely and, more particularly, to a sheet registering device to be applied to a finish-processing device for transporting the sheets while arranging the postures of the sheets and their positional relations to a reference position.

2. Description of the Related Art

In the prior art, some image forming apparatus such as a copying machine for copying the image of an original on a sheet of paper is equipped, as disclosed in Japanese Unexamined Patent Publication JP-A 1-104563, with a sheet finish-processing device for stapling a plurality of sheets. In this sheet finish-processing device, a paddler (having elastic blades) is arranged at an oblique position with respect to a sheet transporting direction, so as to register the sheets supplied to a tray with respect to a reference position. The sheet finish-processing device is further equipped with a mechanism for shifting the paddler to a position which is out of contact with a bundle of the finish-processed (or stapled) sheets, so as to avoid any obstruction to the discharge of the sheet bundle.

With the construction described above, however, the shift of the paddler to the position out of contact with a sheet bundle each time of discharging the sheet bundle will cause a loss in the time when a plurality of sheet bundles are to be made. This is so because the supply of the sheets from the image forming apparatus to the tray has to wait until the paddler returns to the reference position where it can register the sheets.

Unless the paddler is shifted to the position out of contact with the sheet bundle so as to raise the efficiency for preparing the sheet bundle, the sheets cannot be registered. This is because the position where the rotation of the paddler is stopped is not fixed. Specifically, if the sheets are registered widthwise (or transversely) by widthwise registration means, the sheet, as stacked at the uppermost position, is depressed downward by the paddler so that the frictional force of the paddler on the sheets exceeds that between the sheets.

If the registering force of the widthwise registration means is raised, moreover, the sheets are subjected, while being depressed by the paddler, to a transverse force by the widthwise registration means and may possibly be folded or broken.

SUMMARY OF THE INVENTION

The present invention has been conceived in view of the above-specified problems concomitant with the sheet registering device and has an object to provide a sheet registration device capable of registering sheets without any time loss or any folding or breakage of sheets.

In order to achieve the above-specified object, a first sheet registering device comprises: a tray for stacking a plurality of sheets; sheet supplying means for supplying the sheets to the tray; a sheet supply stopper arranged downstream of the tray in the sheet supply direction; elastic blades mounted on a pivotal shaft perpendicular to the sheet supply direction, for advancing the sheets downstream until the downstream end of the sheets supplied to the tray comes into contact with the sheet supply stopper; and widthwise registration means for registering the sheets by reciprocatively moving in a direction perpendicular to the sheet supply direction while contacting with the side end of the sheets supplied to the tray, wherein the sheet registering device further comprises control means for actuating the widthwise registration means after arranging the elastic blades nearly in parallel with the tray and stopping the elastic blades at a rotation stop position where the elastic blades do not contact with the sheets.

The sheet registering device of a second aspect of the invention has structure, in the case of a plurality of elastic blades, the adjoining ones of the elastic blades make an angle not less than a predetermined value so that the elastic blades may not contact with the sheets when the elastic blades are stopped at a rotation stop position.

The sheet registering device of a third aspect of the invention further comprises a sheet guide for guiding the sheets between the pivotal shaft of the elastic blades and the tray, wherein the tray and the sheet guide are provided nearly in parallel so that the elastic blades may not protrude from the sheet guide toward the sheets when the elastic blades are stopped at a rotation stop position.

The sheet registering device of a fourth aspect of the invention has control means for stopping the elastic blades at a rotation stop position each time a predetermined number of sheets are supplied.

According to the first sheet registering device, the sheets can be reliably registered by the widthwise registration means without any contact between the sheet stacked at the uppermost position of the tray and the elastic blades, while preventing the uppermost sheet reliably from being folded or broken.

Moreover, the elastic blades themselves are not shifted, but what is done is to control the rotation stop position of the elastic blades so that a subsequent drive can be instantly effected to eliminate the time loss.

According to the second sheet registering device, the angle, as made between the adjoining elastic blades when they are plurally formed, is no less than the predetermined value so that the folding or breakage of the uppermost sheet can be reliably prevented even the number of elastic blades is increased so as to raise the shifting force of the sheets by the elastic blades. Especially, the angle to be made between at least the two adjoining elastic blades is set to 180 degrees or more.

According to the third sheet registering device, since the sheet guide is provided between the pivotal axis of the elastic blades and the tray so that the elastic blades may not protrude from the sheet guide toward the sheets when the elastic blades are stopped at the rotation stop position, even if the sheets are curled, they can be kept away from contacting with the elastic blades to ensure the stable registration of the uppermost sheet and prevent the sheet breakage.

According to the fourth sheet registering device, since the elastic blades are stopped at a rotation stop position for each predetermined sheet number, the elastic blades need not to be stopped for each sheet so that the transport time can be shortened while ensuring the registration of the sheets.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
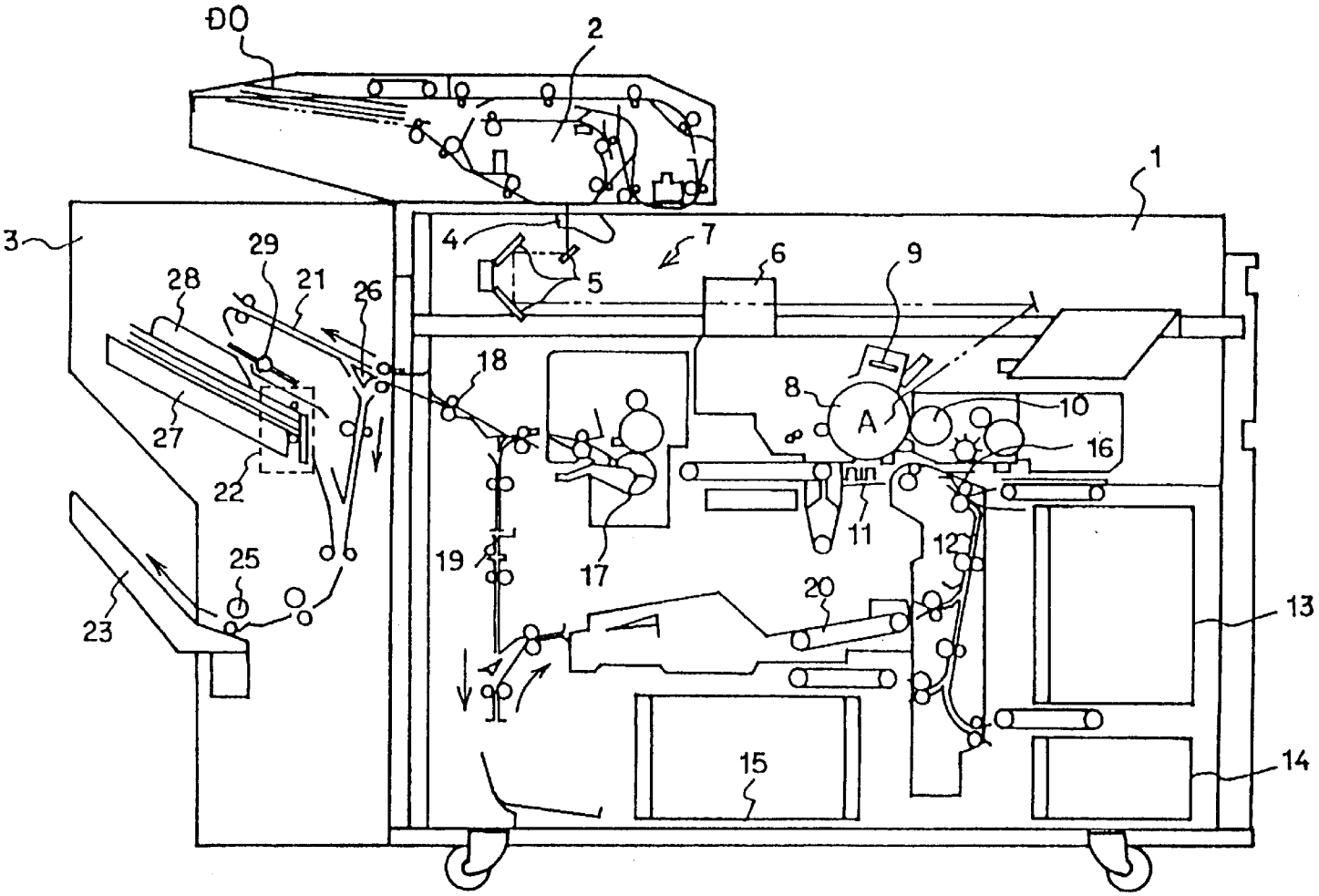
FIG. 1 is a schematic section view showing a copying machine which is equipped with a sheet finish-processing device using a sheet registering device of the invention.

Now referring to the drawings, preferred embodiments of the invention are described below.

With reference to FIGS. 1 to 5, is an embodiment in which a sheet registering device of the invention is employed in a copying machine or an image forming apparatus.

This copying machine has a three-divided construction including a copying machine body 1, an original circulating feed device 2 and a sheet finish-processing device 3.

In an upper portion of the copying machine body 1, there is arranged an optical system 7 which includes a copy lamp 4 of a halogen lamp or the like, a plurality of mirrors 5 and a zoom lens 6.

On the other hand, the original circulating feed device 2 is mounted on the upper end face of the copying machine body 1. This original circulating feed device 2 is constructed to circulate a plurality of originals sequentially so that the originals, as set, may be sequentially irradiated with the light of the copy lamp 4 through a not-shown slit.

The optical system 7 is constructed to scan the original, as transported by the original circulating feed device 2, optically with the light emitted from the copy lamp 4, to irradiate the reflected light to an exposure point A on the surface of a photosensitive drum 8 through the plurality of mirrors 5 and the zoom lens 6, so that an electrostatic latent image corresponding to the image of the document may be formed on the surface, as homogeneously charged by a charger 9, of the photosensitive drum 8.

Around the photosensitive drum 8, there are arranged the charger 9, a developing unit 10 and a transfer unit 11 in that recited order. The electrostatic latent image, as formed on the surface of the photosensitive drum 8, is visualized as a toner image with the toner of the developing unit 10.

Below the photosensitive drum 8, there is provided a sheet transporting path 12 for transporting sheets of paper to the photosensitive drum 8. In the vicinity of this sheet transporting path 12, there are arranged sheet trays 13, 14 and 15 for storing the sheets.

The toner image, on the surface of the photosensitive drum 8, is transferred to the sheet S transported from any one of the sheet trays 13, 14 and 15 through the sheet transporting path 12 and resist rollers 16, as the sheet S passes through between the transfer unit 11 and the photosensitive drum 8. After this transfer, the sheet S is peeled from the photosensitive drum 8.

On the other hand, the copying machine body 1 is equipped with: a fixing unit 17 for applying a heat and a pressure to the sheet S, to which the toner image has been transferred, to fix the toner image on the sheet S; discharge rollers 18 for transporting the fixed sheet S to the sheet finish-processing device 3; and a re-transport path 19 for transporting the sheet again to the photosensitive drum 8 to make copies on both sides. The sheet S, as transported through the re-transport path 19, is incorporated into the sheet transport path 12 via a transport belt 20.

In the copying machine of the present embodiment, moreover, the sheet finish-processing device 3 is arranged downstream of the discharge rollers 18.

The sheet finish-processing device 3 is equipped with: a finish-processing path 21 for supplying the sheets S, as delivered out of the copying machine body 1, within the finish-processing device 3; a finish-processing unit 22 for registering the sheets S and bundling them with staple needles; a discharge unit for discharging the stapled sheets S out of the device 3; and a delivery tray 23 for stacking the stapled sheets S discharged from the device 3.

The finish-processing path 21 has not only a supply mouth 21*a* formed at its one end for supplying the sheets S transported from the copying machine body 1 but also a bypath 21*b* and a main path 21*c* bifurcated midway thereof for transporting the sheets S to the finish-processing unit 22 and to the delivery tray 23 without bundling them, respectively.

A vertical pair of transport rollers 24 are arranged at the trailing end of the bypath 21*b* of the finish-processing path 21, whereas a vertical pair of discharge rollers 25 for discharging the sheets S to the delivery tray 23 are arranged at the trailing end of the main path 21*c*. At the branching point between the bypath 21*b* and the main path 21*c*, there is arranged a deflector 26 acting as path switching means which is pivotal in directions indicated by arrows B1 and B2 for switching the transport path of the sheets S into either the bypath 21*b* or the main path 21*c*.

The finish-processing unit 22 is constructed to include a staple tray 27 acting as a finish-processing plate, a tamper plate 28 acting as widthwise registering means, a paddler 29 and a stapler (not-shown).

The staple tray 27 is so arranged below the finish-processing path 21 with its one end being downslope as to stack the sheets S to be stapled.

Here, the staple tray 27 is equipped with a sheet detecting sensor 30 for detecting whether or not the sheets S are present on the staple tray 27.

The tamper plate 28 is arranged generally at the center, as taken in the direction to transport the sheets S, of the staple tray 27 and is made reciprocally (or back and forth) movable perpendicularly to the transport direction of the sheets S of FIG. 1 so that it can register the sheets S on the staple tray 27 widthwise (or sideways).

The paddler 29 is composed of a pivotal axis 29*a* arranged pivotally in a direction perpendicular to the transporting direction of the sheets S, and two elastic blades 29*b* mounted on the pivotal axis 29*a* so as to be inserted in the pivotal axis 29*a*. The paddler 29 is so arranged that its elastic blades 29*b* abut against the upper face of the lower end of the staple tray 27, and is pivotal in a direction C to transport the sheets S on the staple tray 27 in a predetermined transporting direction.

At the lower end of the staple tray 27, there is provided a stopper 31 for positioning the end portions of the sheets S, as stacked on the staple tray 27, to register the sheets S, as transported by the paddler 29, in the transporting direction.

When the sheets S stapled by the stapler (not-shown) on the staple tray 27 are to be discharged to the main path 21*c* of the finish-processing path 21 by a discharge roller 32, the stopper 31 can be moved downward from the upper face of the staple tray 27 thereby to discharge the stapled sheets S smoothly to the main path 21*c*.

At a discharge mouth of the finish-processing unit 22, there are arranged the discharge roller 32 and its follower roller 33. The discharge roller 32 is pivotally supported at the lower end portion of the staple tray 27 that it can rotate in a direction G. On the other hand, the follower roller 33 is made so pivotal at one end of an arm member 34, which is arranged over the staple tray 27, that it can turn about a fulcrum D in directions E1 and E2.

Moreover, the discharge roller 32 delivers the sheets S to the main path 21*c* of the finish-processing path 21, as it rotates in the direction G, so that the sheets S may be discharged to the delivery tray 23 by the discharge rollers 25.

On the other hand, the follower roller 33 nips the sheets S together with the discharge roller 32 as the arm member 34 is turned in the direction E2 in accordance with the rotation of the discharge roller 32 in the direction G.

The delivery tray 23 is attached downstream of the discharge rollers 25 to the sheet finish-processing device 3 and can be shifted back and forth in the vertical directions, as indicated by arrows H1 and H2, as well as, in the direction perpendicular to the transporting direction of the sheets of FIG. 1 by the actions of an elevator unit 36 and a shift unit 37, as arranged in the vicinity of the attachment portion, so that the position of the discharge roller 32 can be adjusted according to the sheets S to be discharged.

Figure 3:
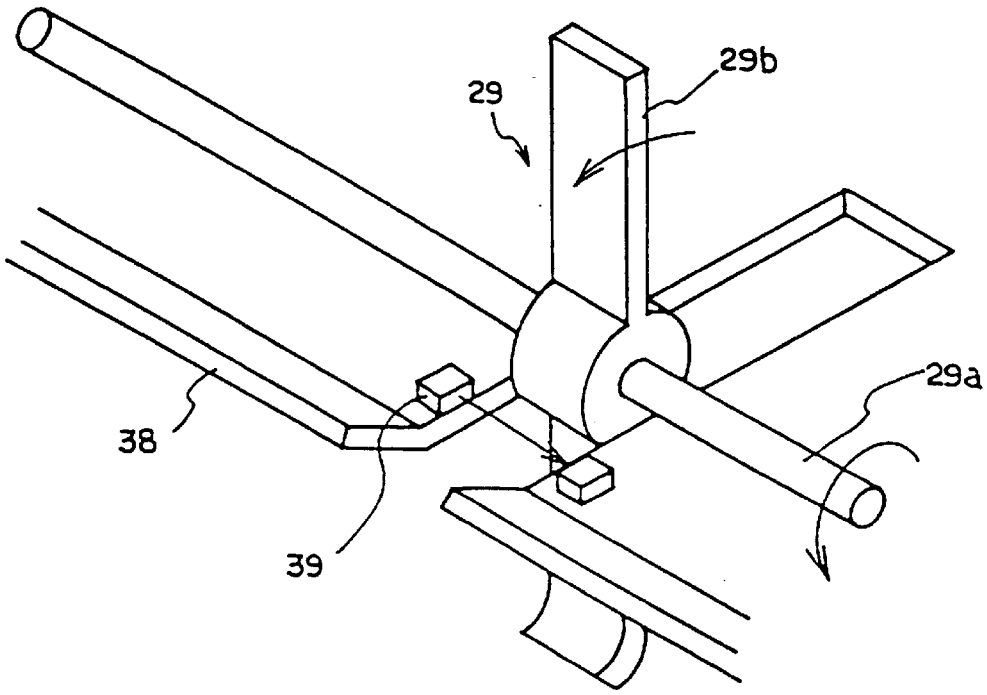
FIG. 3 is an enlarged perspective view showing a rotating state of a paddler of FIG. 2.
Figure 4:
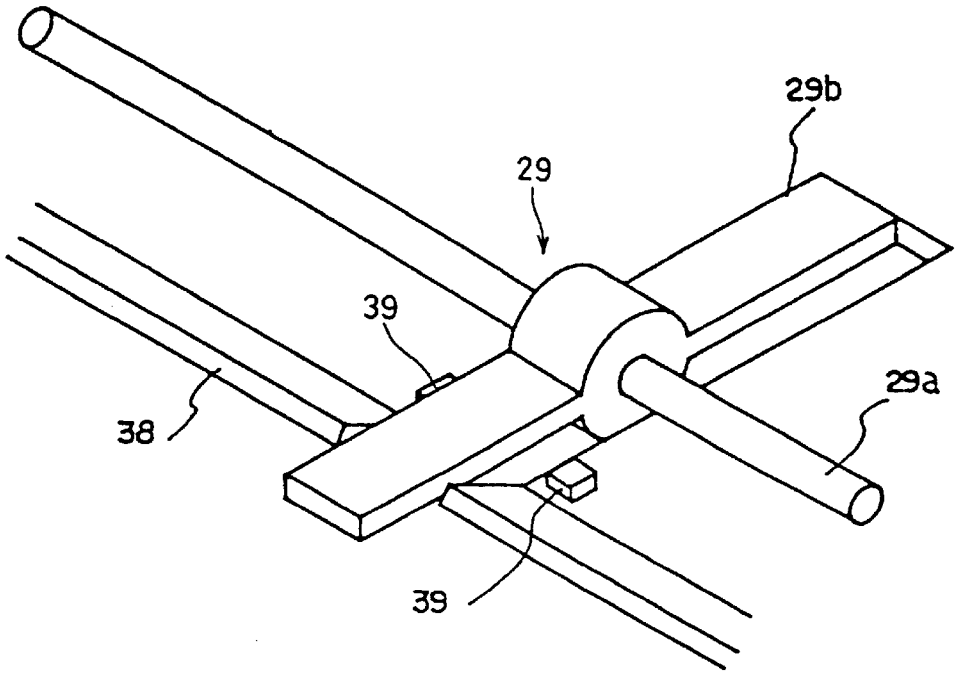
FIG. 4 is an enlarged perspective view showing a rotationally stopped state of the paddler of FIG. 2.
Figure 5:
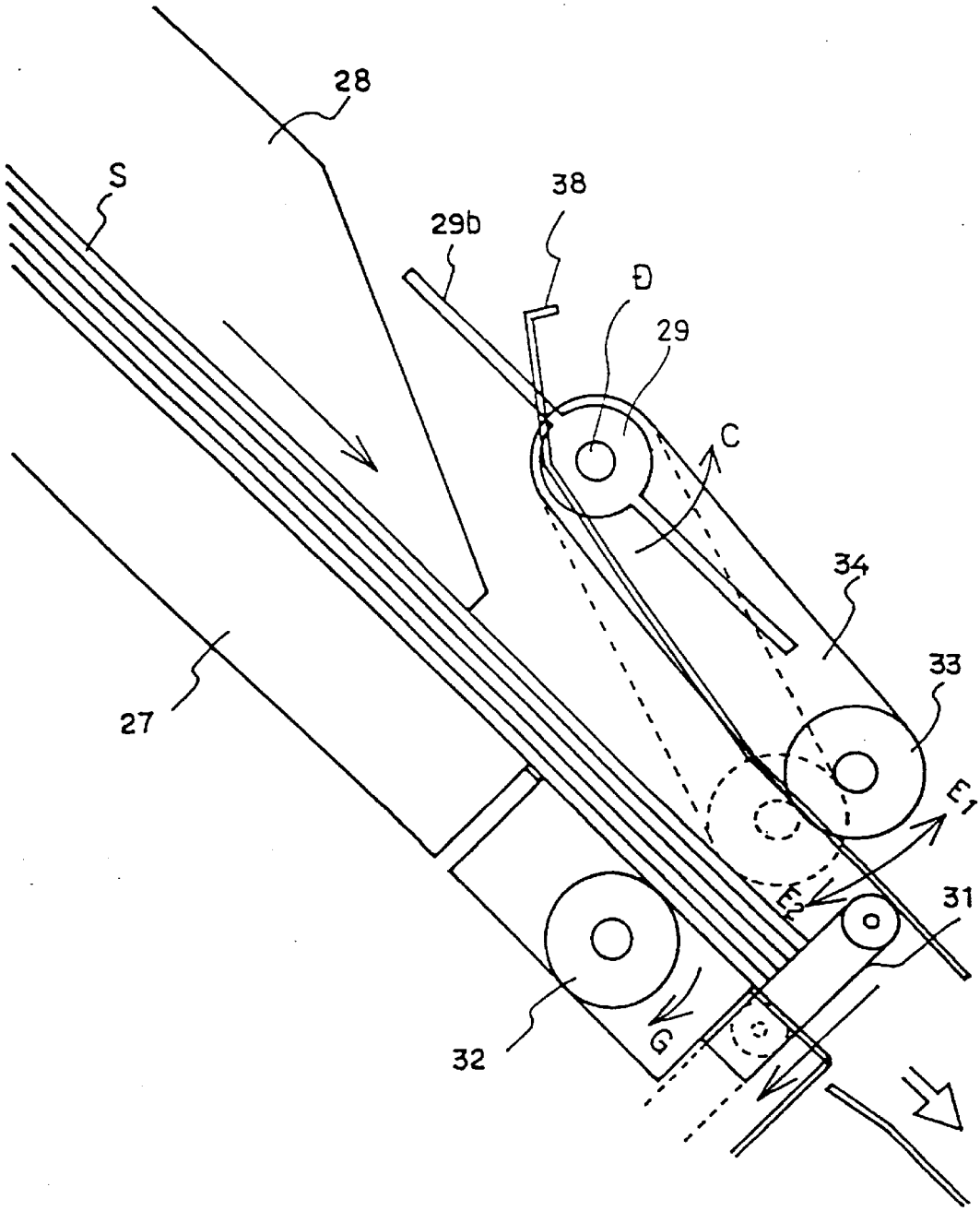
FIG. 5 is an enlarged section view showing an essential portion of FIG. 2.

As shown in FIGS. 3 and 4, the paddler 29 is arranged over a transport guide 38 for guiding the sheets S into between the pivotal axis 29*a* and the staple tray 27. The elastic blades 29 of the paddler 29*b* are kept, when at a rotational stop position (or at a home position), away from protruding below the transport guide 38 and contacting with the sheets S so that they do not apply any pressure to the sheets S. Specifically, the staple tray 27 and the transport guide 38 are arranged generally in parallel so that the rotation of the paddler 29 is controlled so that the tray 27 and the elastic blades 29*b* of the paddler 29 become generally in parallel at the rotational stop position.

Generally, at least the elastic blades 29*b* of the paddler 29 are frequently made of urethane rubber or neoprene rubber but may be advantageously made of vibrationproof rubber for reducing noise and low density urethane foam for reducing contamination.

In the sheet finish-processing device 3 thus constructed, there are arranged a motor for driving only the paddler 29 and a detection sensor (or photosensor) 39 for detecting the position of the elastic blades 29. With the use of the detection sensor 39, the position of the elastic blades 29*b* of the paddler 29 is detected so that the control of stop position the paddler 29 as shown in FIG. 4, is performed, during stapling operation of the sheets S.

The shape of the elastic blades 29*b* of the paddler 29 will be described with reference to FIG. 6.

The number of the elastic blades 29*b* of the paddler 29 is selected to be two or four. In the case of two blades (as indicated by solid lines), these two blades 29*b* are desirably arranged at an angle of $\theta$=180 degrees (as made between the two elastic blades 29*b*) so that they may register the sheets S well balanced in the transporting direction and may be stopped at the rotational stop position while being kept away from contacting with the sheets S. In the case of arrangement of $\theta$=180 degrees, the rotation stop position of the paddler 29 can be easily controlled because the rotation stop position occurs twice for one rotation.

Figure 6:
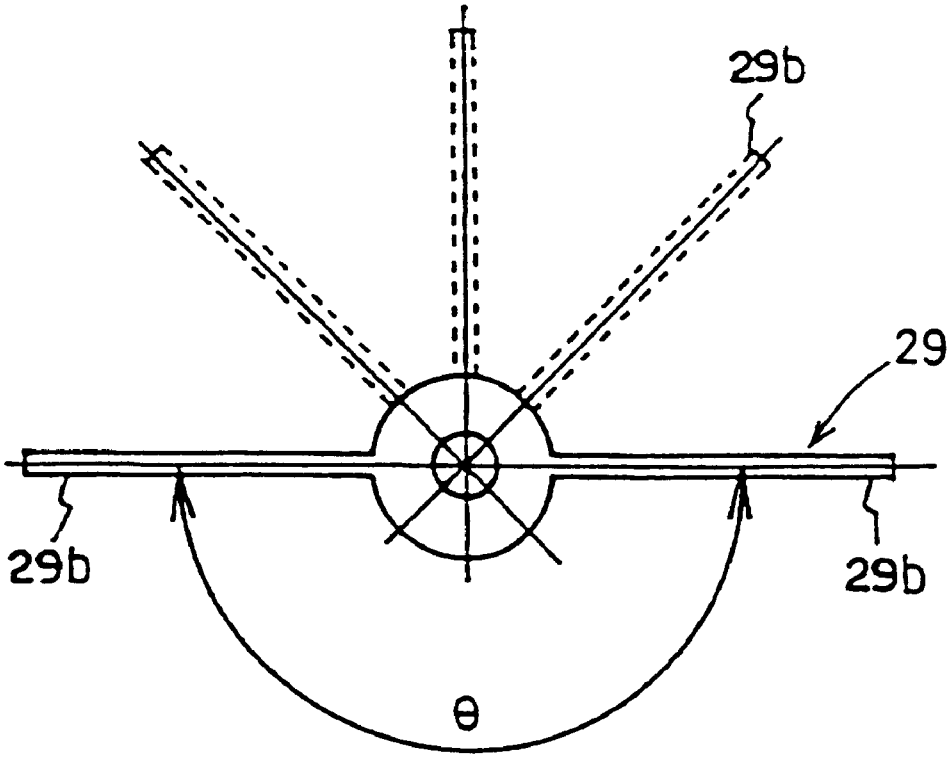
FIG. 6 is a section view showing the paddler.

Even in case three or more (or five including the elastic blades, as indicated by broken lines in FIG. 6) of the elastic blades 29*b* within one of rotation angles (i.e., 180 degrees) of the paddler 29, this paddler 29 can be stopped in the state (in which the elastic blades 29*b* are kept away from abutting against the sheets S), as shown in FIG. 6, by detecting the position, in which the largest angle $\theta$ (i.e., 180 degrees) made by the two adjoining elastic blades 29*b* is directed toward the sheets S, by means of the detection sensor 39. Then, the rotation stop position occurs once for one rotation. This rotation stop position can also be controlled by a timer or the like in place of the detection sensor 39.

Figure 7:
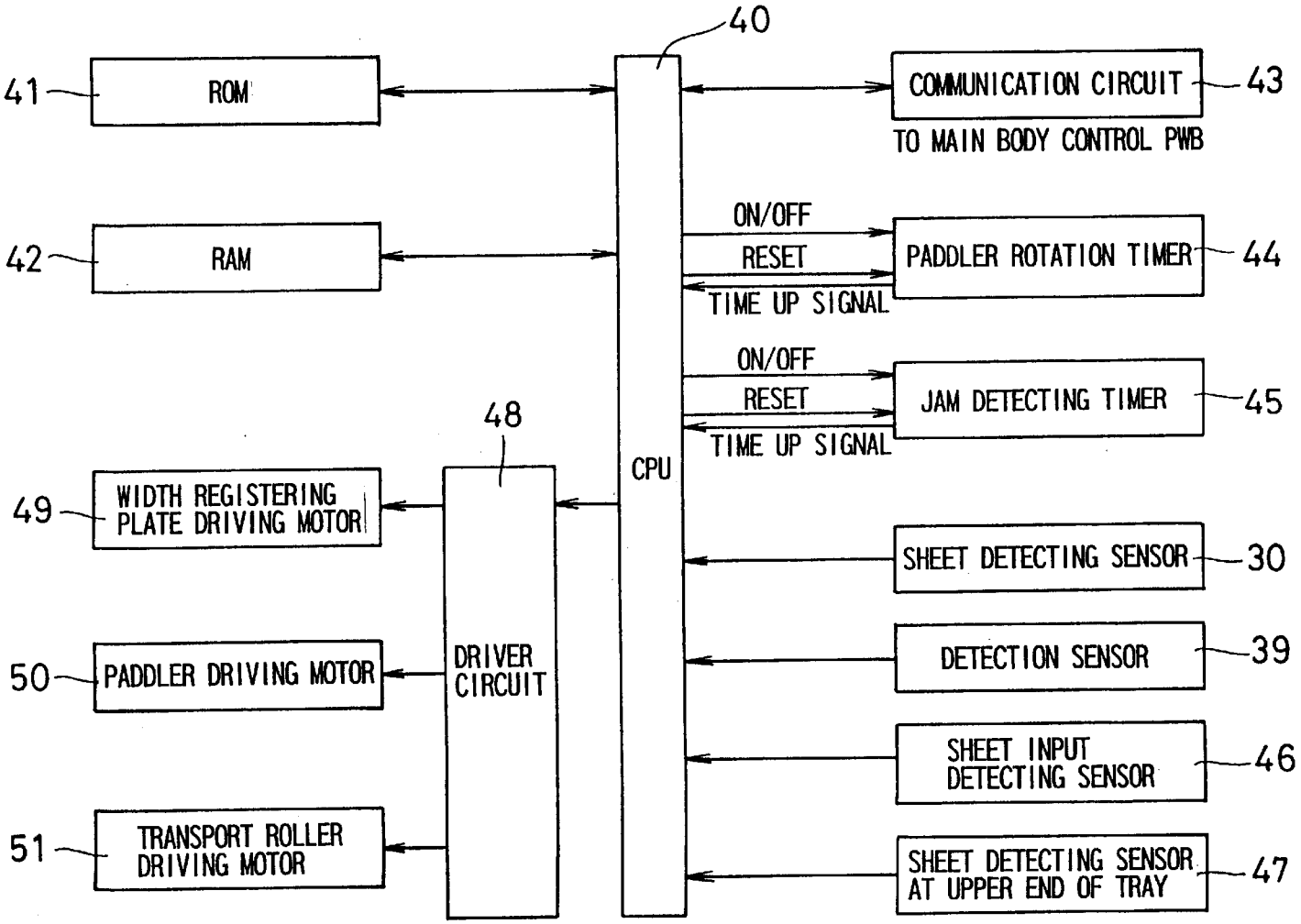
FIG. 7 is a control block diagram of the sheet finish-processing device of the invention.

FIG. 7 shows a block diagram showing a circuit for controlling the sheet finish-processing device 3 of the invention. A CPU (i.e., Central Processing Unit) 40 processes a variety of information such as the sensor state to perform load control in the unit or the like. A ROM 41 is stored with a control program for operating the CPU 40. A RAM 42 stores a variety of data to be used for controls and to be managed and updated by the access from the CPU 40. A communication circuit 43 performs data communications with a main body control unit and controls not only the actions of units having received the JAM information from the main body, the mode data by a key input, emergency stop data or the like, and contrarily transmits the information issued from the units to the main body so as to control the operation and display of the main body. A paddler rotation timer 44 is used for rotating the paddler 29 for a predetermined time period, and a JAM detecting timer 45 is used for detecting the JAM for a transport time interval.

The detection sensor 39 is used to detect a home position of the paddler 29, and a sheet input detecting sensor 46 is used for detecting the sheets S to be supplied from the copying machine main body 1 to the sheet finish-processing device 3 and is arranged at the supply mouth 21*a* of the sheet finish-processing device 3. The sheet detecting sensor 30 is used for detecting the sheets on the staple tray 27, and a upper-tray sheet detecting sensor 47 is arranged at the upper end portion of the staple tray 27.

Those sensors 30, 39, 46 and 47 are used for detecting the sheets on the transporting path.

A driver circuit 48 drives a tamper plate driving motor 49 for shifting the tamper plate 28, a paddler driving motor 50 for rotating the paddler 29, and a transport roller driving roller 51.

Figure 8:
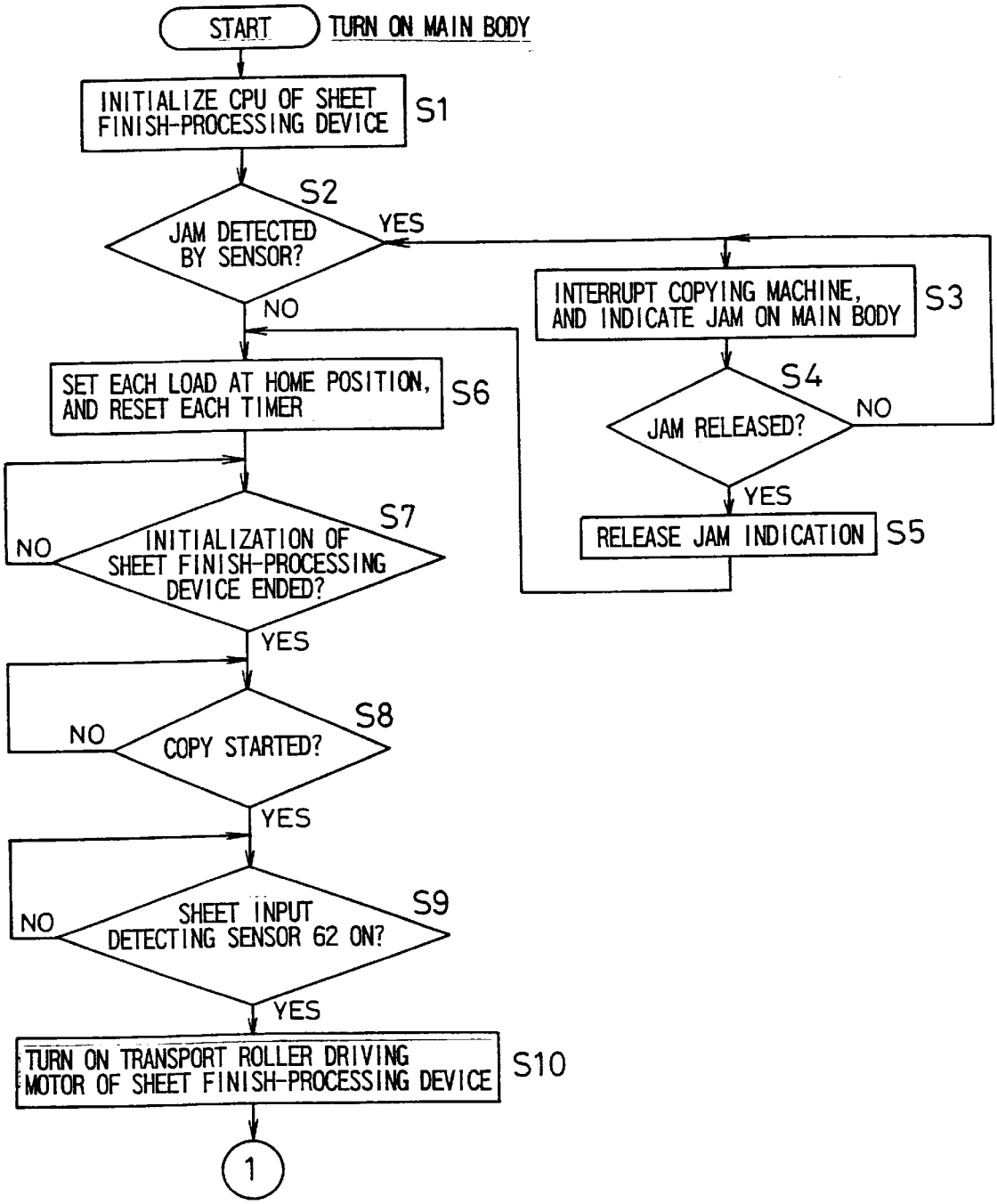
FIG. 8 is a first flow chart showing the operations of the sheet finish-processing device of the invention.
Figure 9:
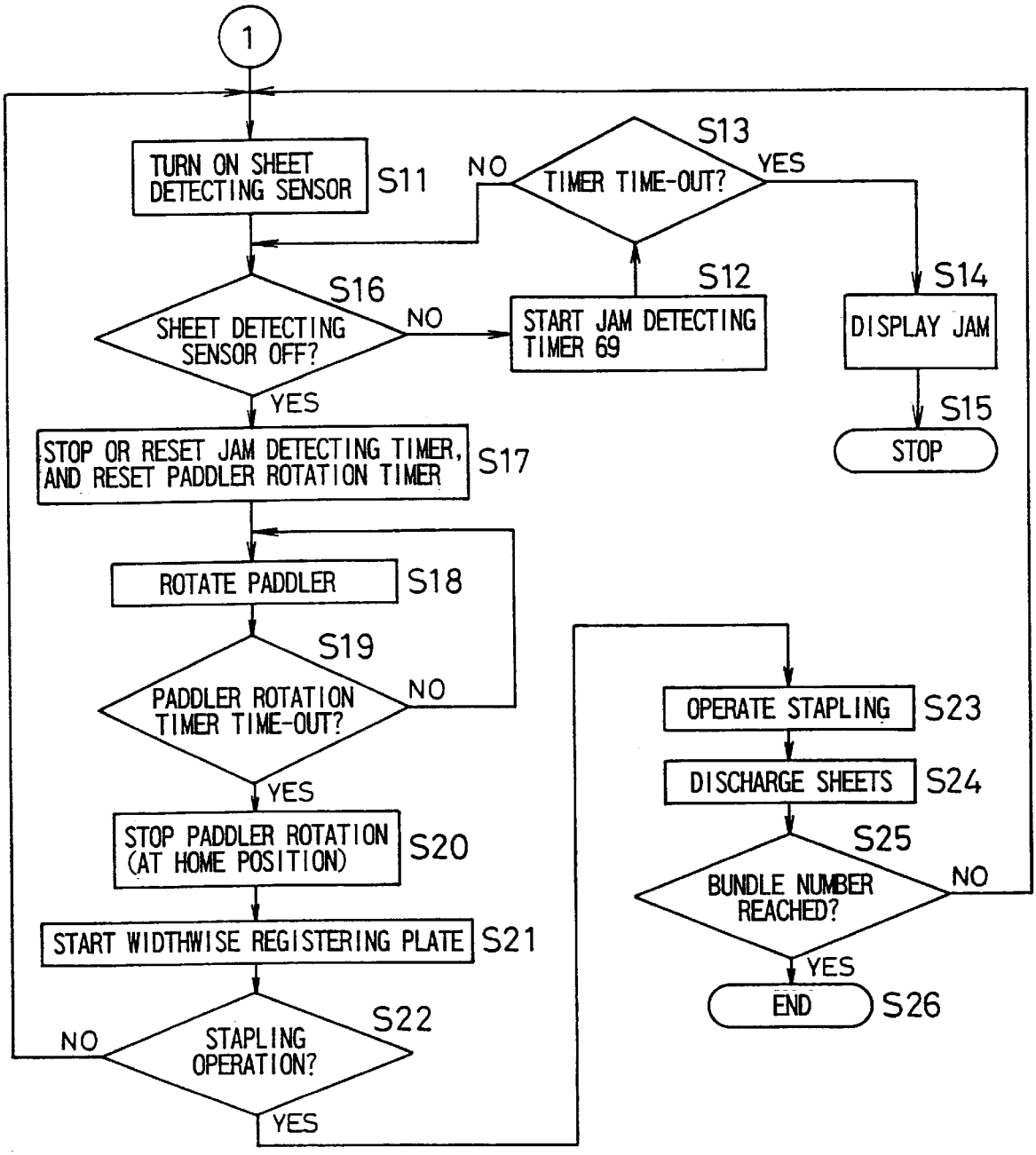
FIG. 9 is a second flow chart showing the operations of the sheet finish-processing device of the invention.

With the construction thus far described, operation process of stapling the sheets S in the sheet finish-processing device 3 will be described with reference to the flow charts, as shown in FIGS. 8 and 9. Simultaneously as the main power of the copying machine main body 1 is turned ON, the control PWB (e.g., the CPU) 40 of the sheet finish-processing device 3 is initialized (at S1), and the sensor states are checked (at S2). When the JAM is detected, the JAM information is instantly transmitted to the copying machine main body 1 to interrupt the operation of the copying machine or to display the JAM (at S3). When a JAM release is detected (at S4), the operation interruption s of the copying machine, or the JAM display is canceled (at S5), and the each load is shifted to the home position to enter in preparing the copying operation.

At this time, each timer is reset (at S6).

The sheet finish-processing device 3 transmits the end of initialization to the main body (at S7) and awaits a start of copying operation from the body (at S8). When the copying operation starts so that the sheet input detecting sensor 46 in the vicinity of the supply mouth of the sheet finish-processing device 3 is turned ON (at S9), the transport roller driving motor 51 is turned ON (at S10). When the upper-tray sheet detecting sensor 47 arranged at the upper portion of the staple tray 27 is turned ON (at S11) and left ON, the JAM detecting timer 45 is started (at S12). In the case of a time out (at S13), the JAM is decided (at S14), and the JAM display and the interruption of the copying machine are performed (at S15). When the sheet detecting sensor 47 is turned OFF (at S16), the JAM detecting timer 45 is stopped or reset, and the paddler rotation timer 44 for the paddler 29 rotating for a predetermined time period is reset (at S17).

Since the sheets are transported to the staple tray 27 (as decided according to ON/OFF of the sheet detecting sensor 30), the paddler rotation timer 44 of the paddler 29 is started to rotate the paddler 29 thereby to register the sheets in the transporting direction (at S18). When the paddler rotation timer 44 is timed out (at S19), the paddler 29 is stopped in parallel with the paddler 29 (between the sheets and the elastic blades 29*b*) (at S20), and the tamper plate 28 is activated to register the sheets in the direction perpendicular to the transporting direction (at S21). It is confirmed (at S22) that the number of sheets to be stapled is completed. In the case of completion, the sheets are stapled (at S23), and a bundle of stapled sheets is discharged to the delivery tray 23 (at S24). If the number of sheets is short, the routine is repeated from the supply of the sheets. The number of stapled sheet bundles is confirmed (at S25), and the operations of the copying machine is interrupted (at S26) when the bundle number is completed. When the bundle number is short, the routine is repeated from the supply of sheets to the stapling operation.

Figure 10:
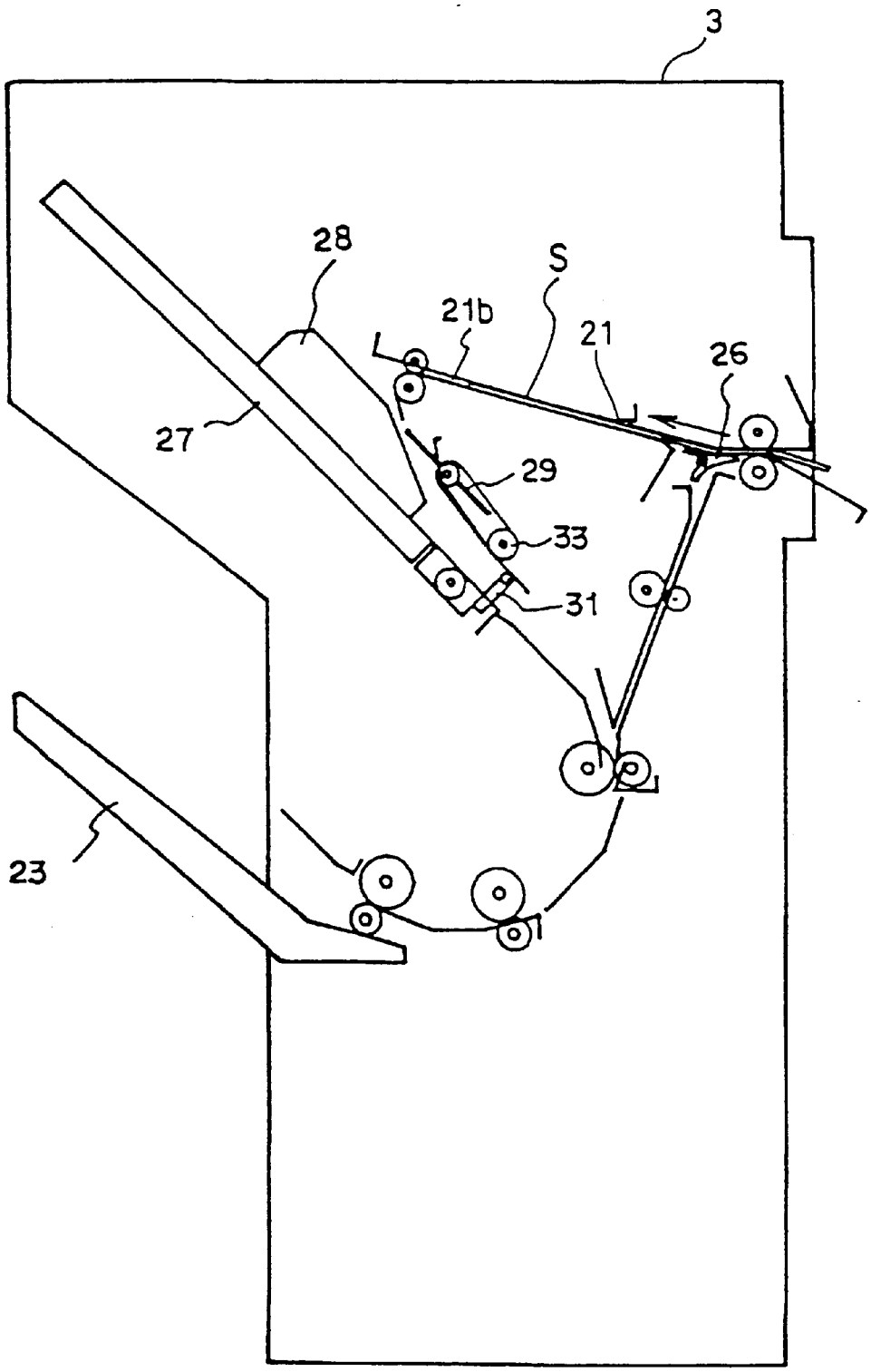
FIG. 10 is a section view showing the sheet finish-processing device at the time of supplying the sheets to the sheet finish-processing device.
Figure 11:
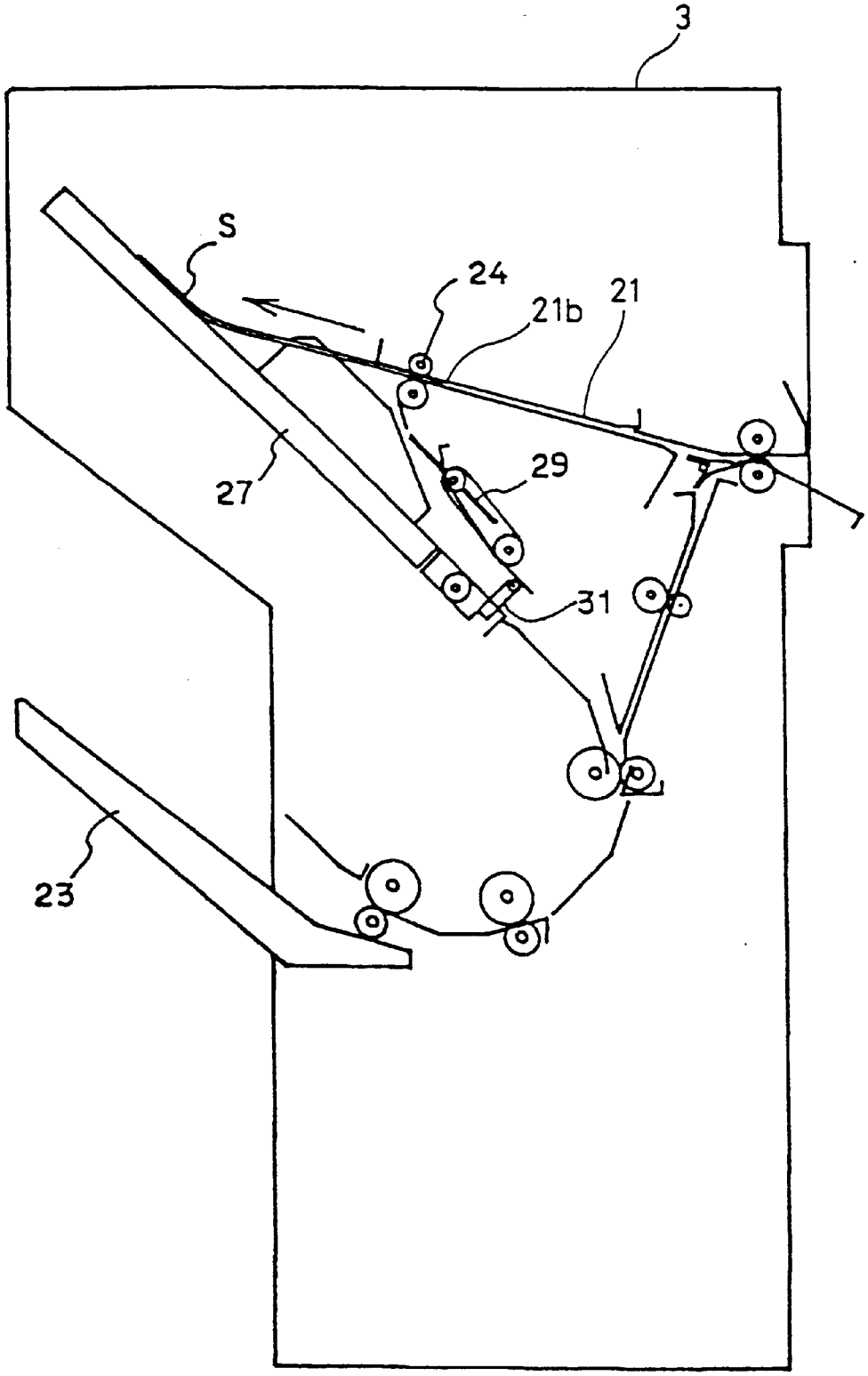
FIG. 11 is a section view showing the sheet finish-processing device at the time of transporting the sheets to a staple tray of the sheet finish-processing device.
Figure 12:
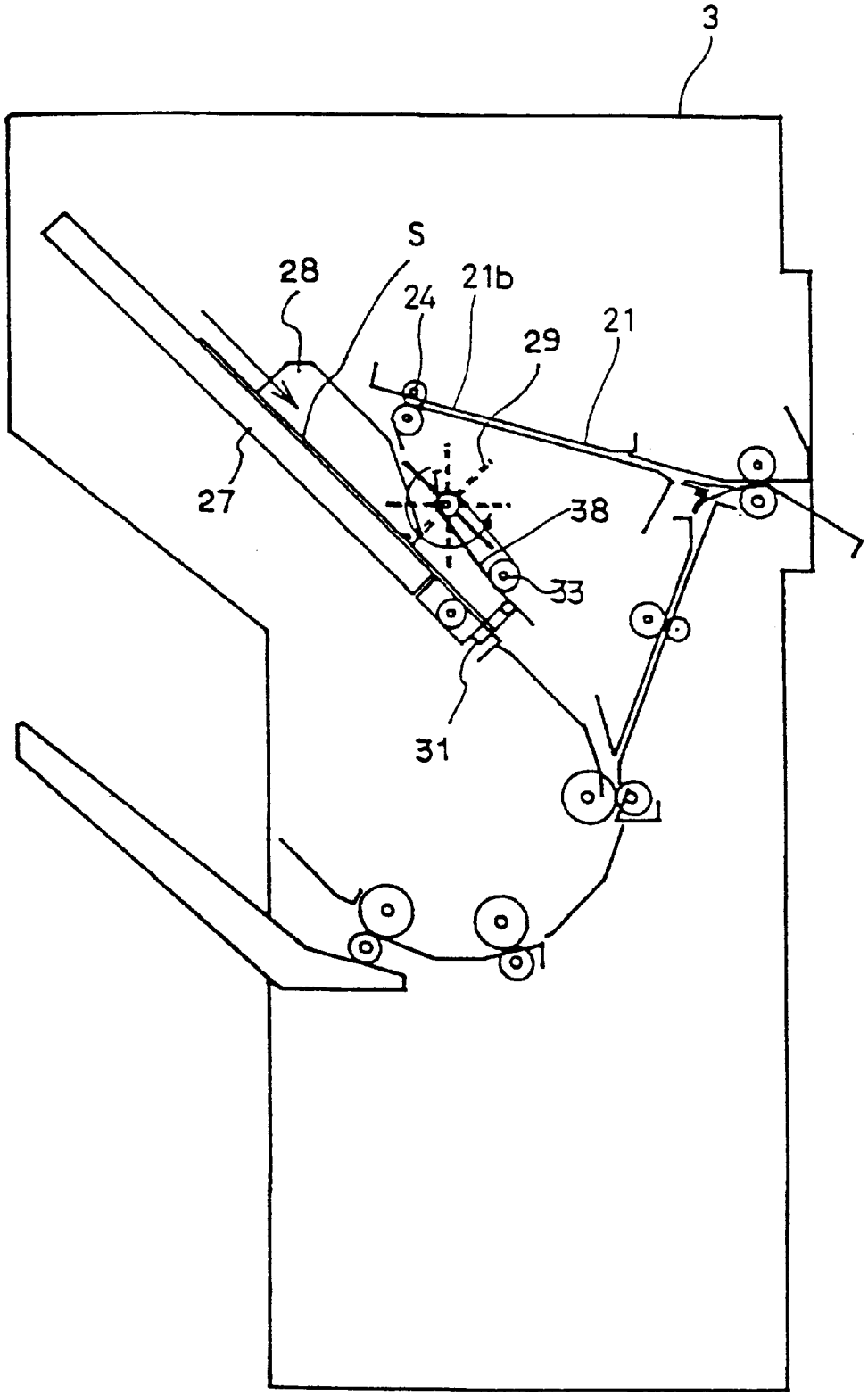
FIG. 12 is a section view of the sheet finish-processing device and shows a state in which the sheets over the staple tray are being transported by the paddler.
Figure 13:
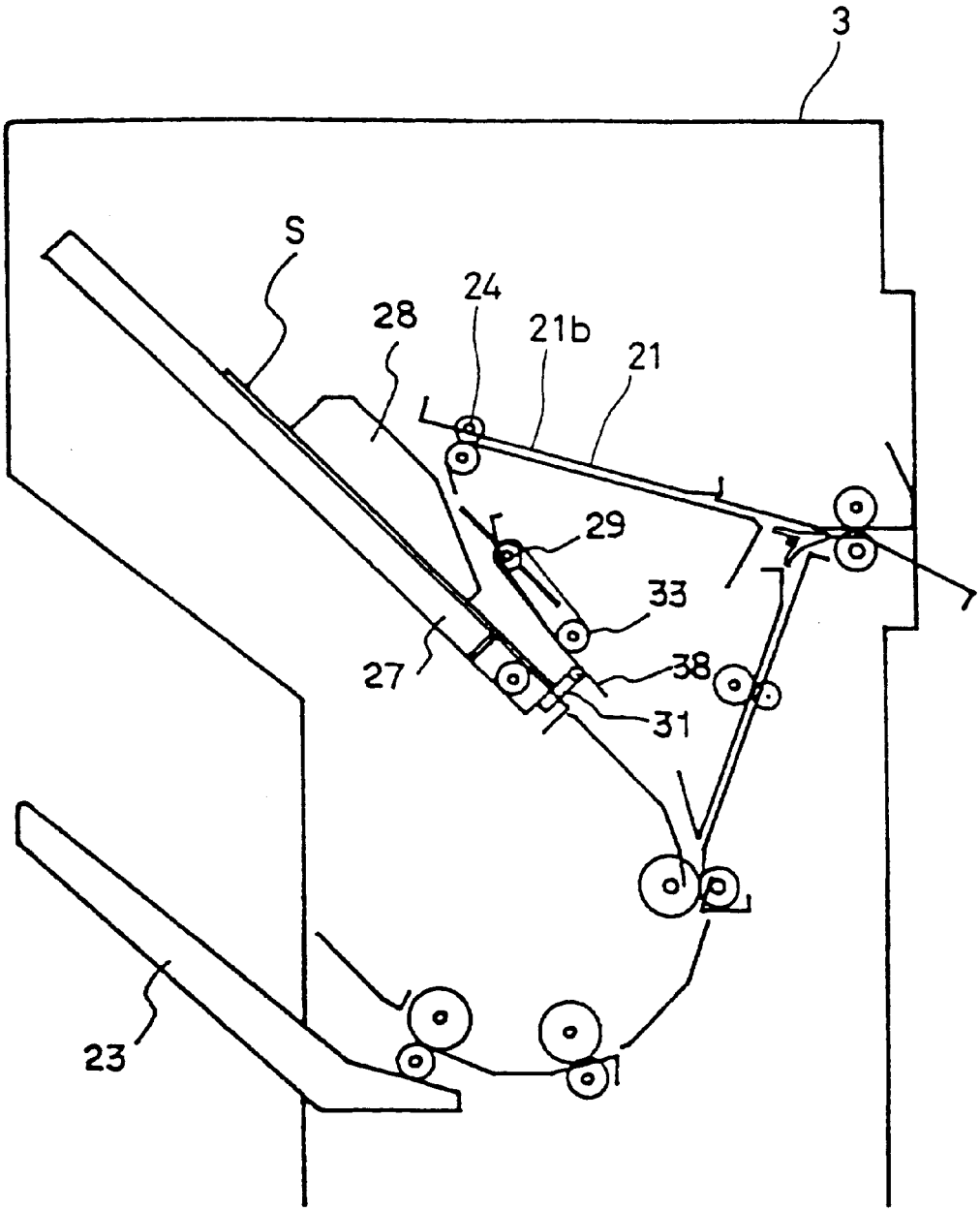
FIG. 13 is a section view of the sheet finish-processing device and shows a state in which the paddler is stopped in rotation.
Figure 14:
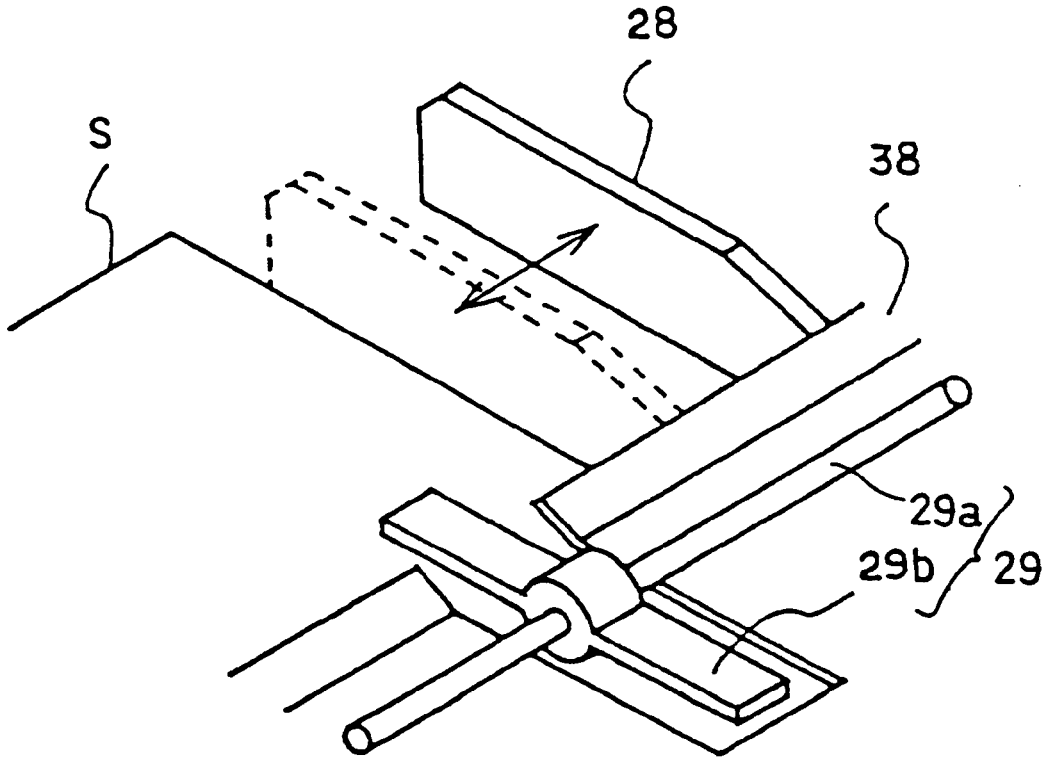
FIG. 14 is a perspective view showing a paddler portion of FIG. 13.

In the case of the stapling operation of the sheet finish-processing device 3 thus far described, the sheets S, as supplied from the supply mouth, are transported through the bypath 21*b* of the finish-processing path 21 (as shown in FIG. 10), stacked on the staple tray 27 by the discharge rollers 24 (as shown in FIG. 11), and registered in the transporting direction by the stopper 31 in accordance with the rotation of the paddler 29, as positioned above the transport guide 38, (as shown in FIG. 12). When the paddler 29 has rotated for a predetermined time period, it stops at the horizontal position (or the home position) level with the staple tray 27 so that the sheets are registered in the direction perpendicular to the transporting direction by the tamper plate 28 (as shown in FIGS. 13 and 14).

Figure 15:
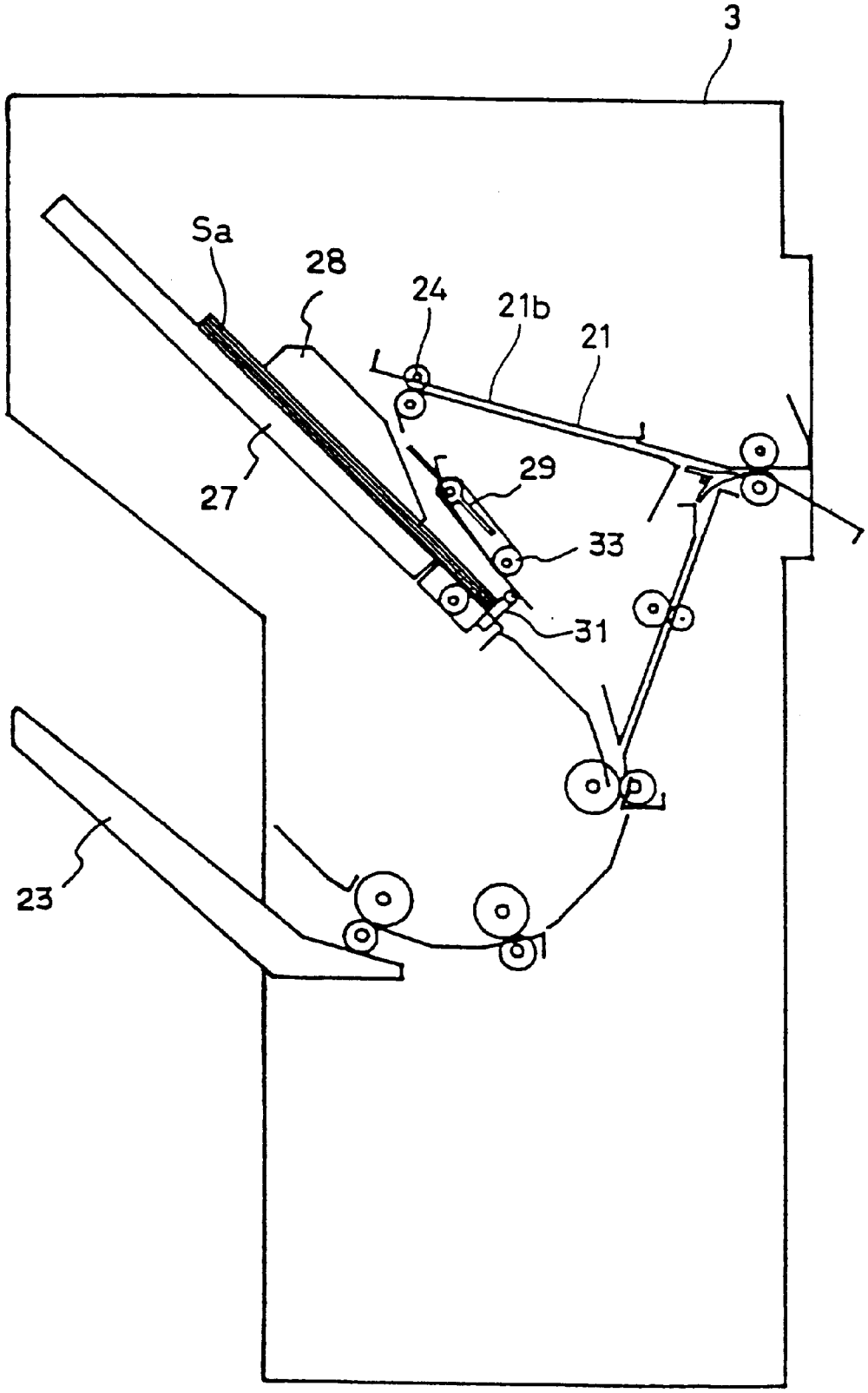
FIG. 15 is a section view of the sheet finish-processing device and shows the state in which the sheets are being stapled at the staple tray.
Figure 16:
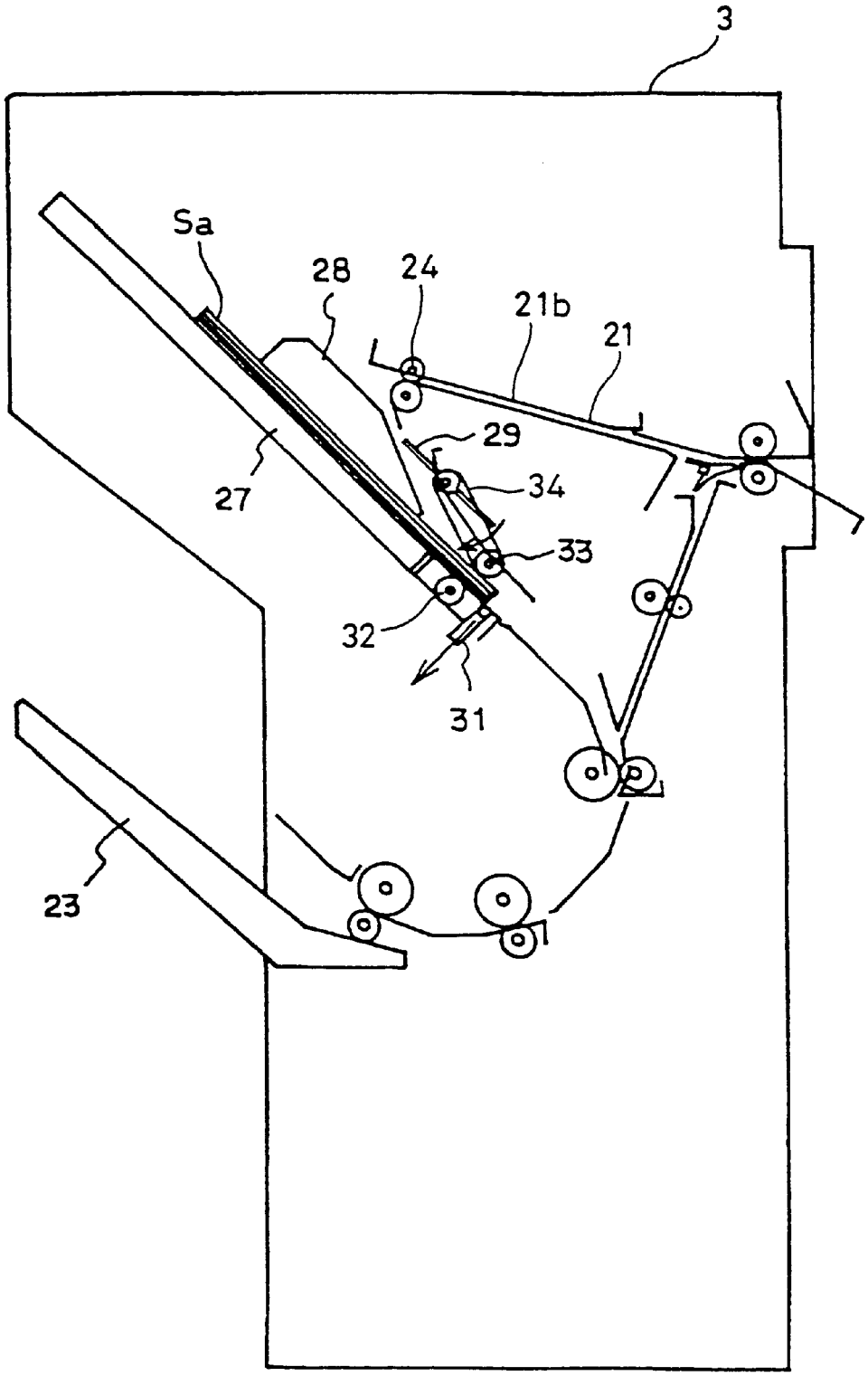
FIG. 16 is a section view of the sheet finish-processing device and shows a state in which a stopper is active at the time of transporting the stapled sheets.
Figure 17:
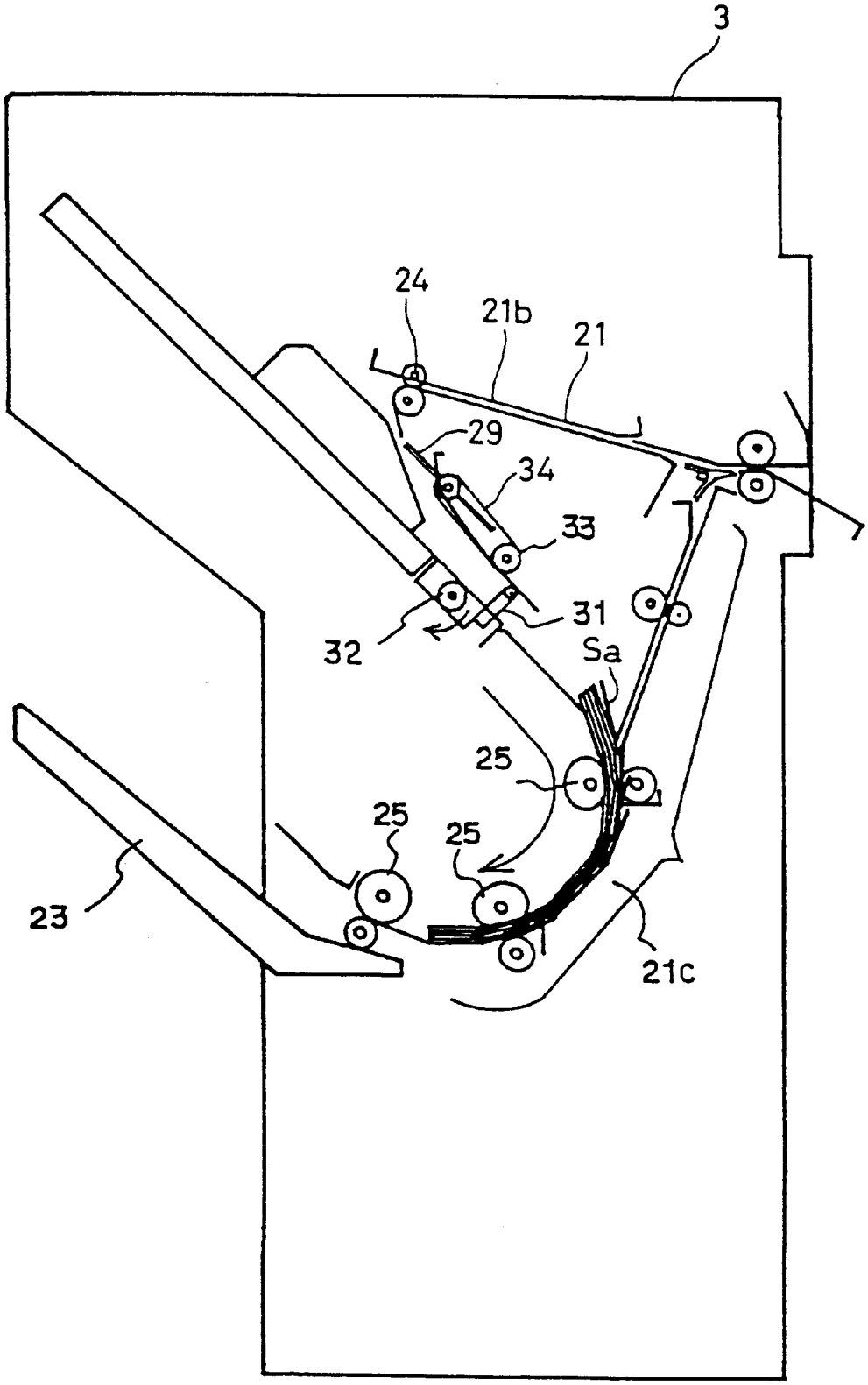
FIG. 17 is a section view of the sheet finish-processing device and shows a state in which the stapled sheets are being transported.
Figure 18:
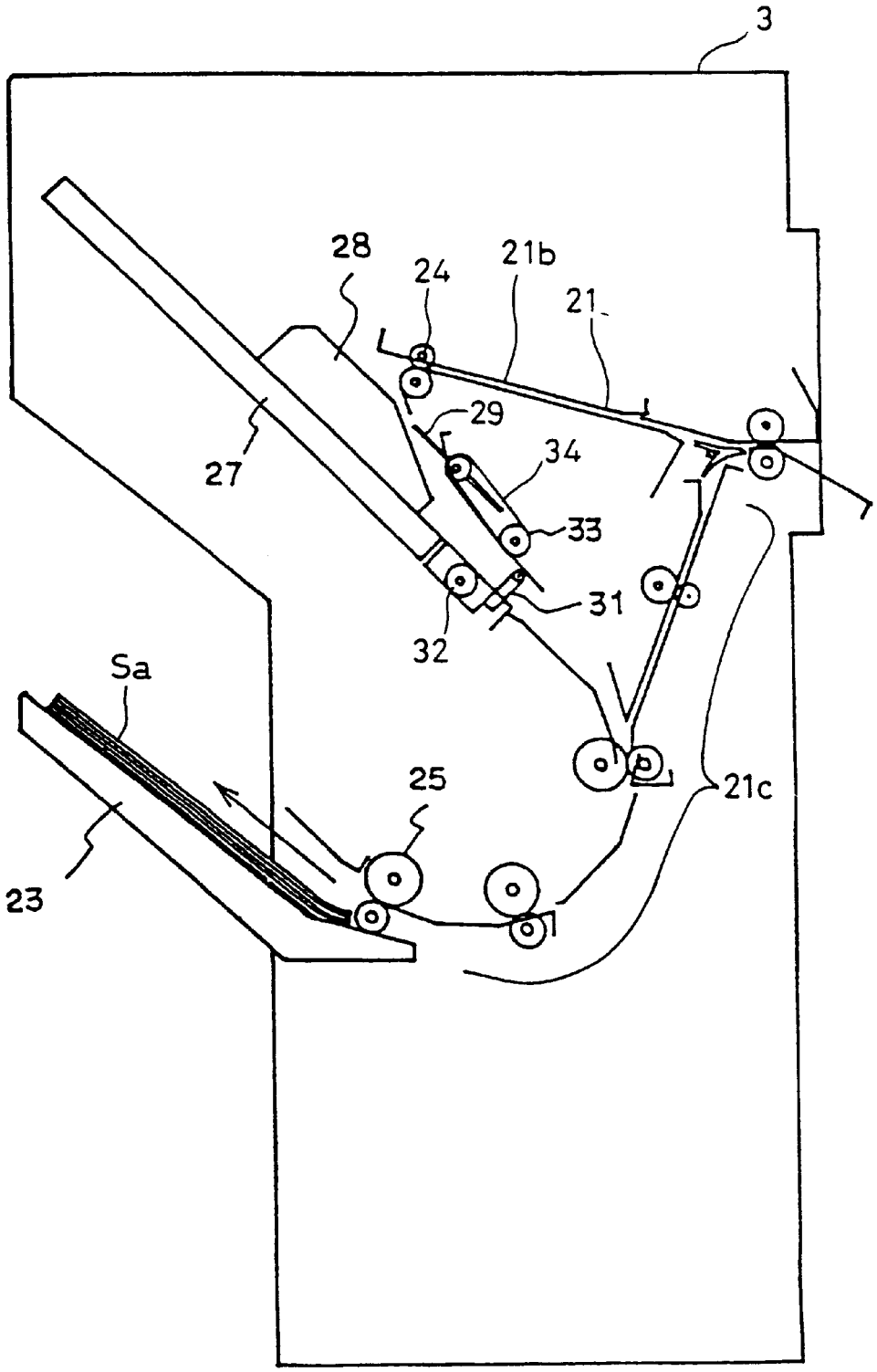
FIG. 18 is a section view of the sheet finish-processing device and shows the state in which the stapled sheets are outputted to a delivery tray.

Operations of FIGS. 10 to 13 are repeated until the sheets number reaches to (as shown in FIG. 15) the stapling operation is performed the desired bundle number, then the stopper 31 and the arm member 34 are actuated (as shown in FIG. 16), and the stapled sheet bundle Sa is discharged and transported (as shown in FIG. 17) to the main path 21*c* by the rotation of the discharge roller 32, and then the sheet bundle Sa is delivered (as shown in FIG. 18) to the delivery tray 23 by the discharge rollers 25.

Here, the sheets S are registered, while being stacked on the staple tray 27, alternately in the two directions without any interference between the paddler 29 and the tamper plate 28 acting as registration means, so that their registration is ensured to keep the stapled quality of the sheets S.

Figure 2:
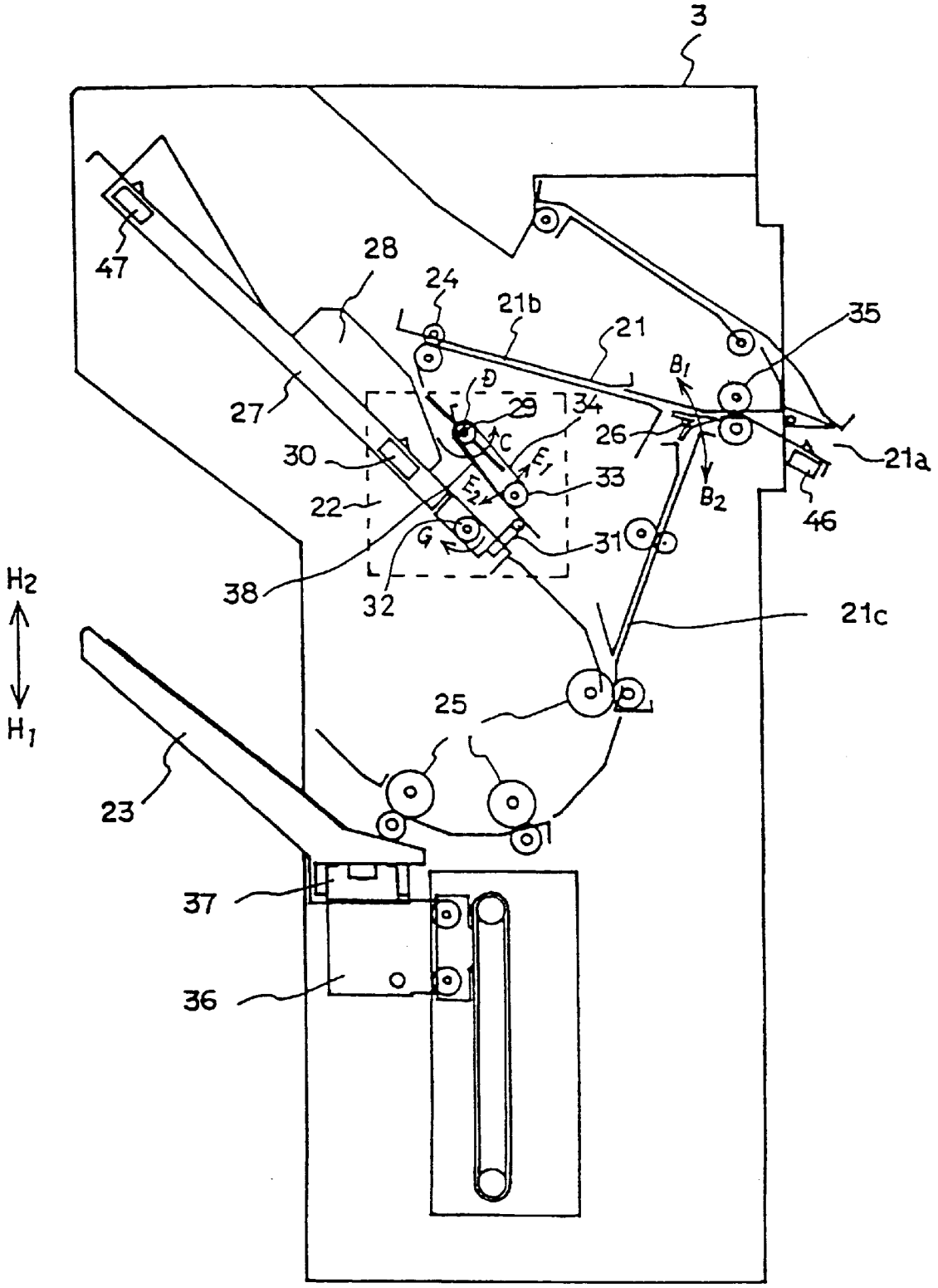
FIG. 2 is a section view showing the sheet finish-processing device of the invention.

In the rotation stop position control of the paddler 29, according to another embodiment, a copying machine, which is equipped with sheet finish-processing device 3 having a mechanism for stopping a predetermined number of copied sheets such as ten sheets, will be described with reference to FIG. 2. The number of sheets S having entered the sheet finish-processing device 3 is counted by the sheet input detecting sensor 46 so that its information is stored and updated in the RAM 42. The paddler 29 or the registration means continues its operation till the set number (i.e., ten) programmed in the ROM 41 is reached. At the set number, the CPU 40 causes the driver circuit 48 to stop the paddler 29 at the position (which is kept away from contact with the sheets) in parallel with the staple tray 27 and to perform the registering operation by the tamper plate 28. After this tamper plate 28 left the sheets, the CPU 40 actuates again the paddler 29. The operations described above are repeated to complete the sheet finish-processing operation.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A sheet registering device comprising:

a tray for stacking a plurality of sheets thereon;

sheet supplying means for supplying the sheets to the tray;

a sheet supply stopper arranged downstream of the tray in the sheet supply direction;

elastic blades mounted on a pivotal shaft perpendicular to the sheet supply direction, for advancing the sheets downstream until the downstream end of the sheets supplied to the tray comes into contact with the sheet supply stopper; and widthwise registration means for registering the sheets by reciprocatively moving in a direction perpendicular to the sheet supply direction while contacting with side end of the sheets supplied to the tray, wherein the sheet registering device further comprises control means for actuating the widthwise registration means after arranging the elastic blades nearly in parallel with the tray and stopping the elastic blades at a rotation stop position where the elastic blades do not contact with the sheets.

2. The sheet registering device of claim 1, wherein, in the case of a plurality of elastic blades, the adjoining ones of the elastic blades make an angle not less than a predetermined value so that the elastic blades may not contact with the sheets when the elastic blades are stopped at the rotation stop position.

3. The sheet registering device of claim 2, wherein at least two adjoining elastic blades are at an angle of 180 degrees or more.

4. The sheet registering device of claim 1 further comprising:

a sheet guide for guiding the sheets between the pivotal shaft of the elastic blades and the tray, wherein the tray and the sheet guide are provided nearly in parallel so that the elastic blades may not protrude from the sheet guide toward the sheets when the elastic blades are stopped at the rotation stop position.

5. The sheet registering device of claim 1, wherein the control means stops the elastic blades at the rotation stop position each time a predetermined number of sheets are supplied.

* * * * *